United States Patent [19]

Fujiwara et al.

[11] Patent Number: 4,493,739

[45] Date of Patent: Jan. 15, 1985

[54] PROCESS FOR PRODUCING A GRAIN-ORIENTED ELECTROMAGNETIC STEEL SHEET OR STRIP HAVING A LOW WATT LOSS AND A GRAIN-ORIENTED ELECTROMAGNETIC STEEL STRIP HAVING UNIFORM MAGNETIC PROPERTIES

[75] Inventors: Koichi Fujiwara; Tomohiko Sakai; Yoneo Yamada; Kazutaka Higashine, all of Himeji, Japan

[73] Assignee: Nippon Steel Corporation, Tokyo, Japan

[21] Appl. No.: 405,107

[22] Filed: Aug. 4, 1982

[30] Foreign Application Priority Data

Aug. 5, 1981 [JP] Japan ..... 56-121862

[51] Int. Cl.[3] ..... H01F 1/04

[52] U.S. Cl. ..... 148/111; 148/112

[58] Field of Search ..... 148/111, 113, 110, 112

[56] References Cited

U.S. PATENT DOCUMENTS

| | | | |
|---|---|---|---|
| 2,867,557 | 1/1959 | Crede et al. | 148/111 |
| 3,239,332 | 3/1966 | Goss | 148/111 |
| 3,802,937 | 4/1974 | Kobler et al. | 148/111 |
| 3,855,018 | 12/1974 | Salsgiver et al. | 148/112 |
| 3,872,704 | 3/1975 | Ohya et al. | 148/111 |
| 4,171,994 | 10/1979 | Miller | 148/111 |
| 4,212,689 | 7/1980 | Shimizu et al. | 148/111 |
| 4,371,405 | 2/1983 | Harase et al. | 148/111 |

FOREIGN PATENT DOCUMENTS 48-69720 9/1973 Japan .

*Primary Examiner*—John P. Sheehan

*Attorney, Agent, or Firm*—Cushman, Darby & Cushman

[57] ABSTRACT

In the production of a grain-oriented electromagnetic steel strip or sheet having a low watt loss, a silicon steel slab containing not more than 0.085% by weight of carbon, from 2.0% to 4.0% by weight of silicon, from 0.030% to 0.090% by weight of manganese, and from 0.010% to 0.060% by weight of sulfur is conventionally hot-rolled, cold-rolled, and final-annealed. However, this production process involves some problems in regard to the uniformity of the magnetic properties along the full length of the coiled strip. According to the present invention, a silicon steel slab additionally contains from 0.02% to 0.2% by weight of copper, the exit temperature during the finishing-hot-rolling step is controlled in such a manner that the temperature of the top portion of the hot-rolled strip is in the range of from 900° C. to 1050° C. and the temperature of the middle and bottom portions thereof is in the range of from 950° C. and 1150° C., and final cold-rolling is carried out at a reduction ratio of from 50% to 80%, with the result that the final product has good and very uniform magnetic properties over the full length thereof.

6 Claims, 7 Drawing Figures

Figure 1A:
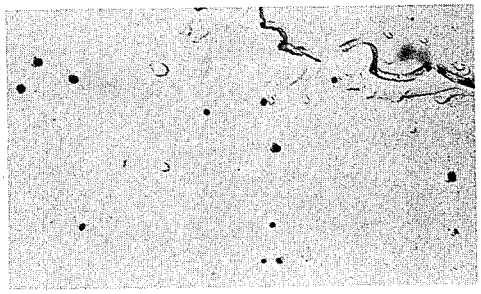
Figure 1B:
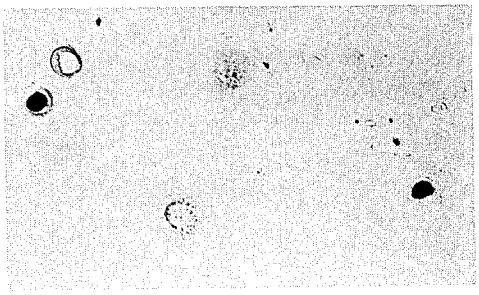
Figure 1C:
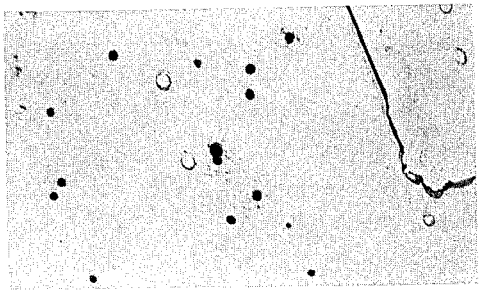

PROCESS FOR PRODUCING A GRAIN-ORIENTED ELECTROMAGNETIC STEEL SHEET OR STRIP HAVING A LOW WATT LOSS AND A GRAIN-ORIENTED ELECTROMAGNETIC STEEL STRIP HAVING UNIFORM MAGNETIC PROPERTIES

The present invention relates to a process for producing a grain-oriented electromagnetic steel sheet or strip in which the crystals of the steel sheet or strip have an orientation of {110}<001>, the steel sheet or strip being easily magnetized in the rolling direction. The present invention also relates to a grain-oriented electromagnetic steel strip having uniform magnetic properties.

A grain-oriented electromagnetic steel sheet is used as soft magnetic material and is mainly used as the core material of transformers and various electrical machinery and apparatuses. In view of the shortage of electrical power and the need to conserve energy, there has recently been an increasing demand for a grain-oriented electromagnetic steel sheet or strip exhibiting a watt loss lower than that of conventional grain-oriented electromagnetic steel sheets or strips.

U.S. Pat. No. 3,872,704 discloses a process for producing a grain-oriented electromagnetic steel sheet or strip in which dispersion phases consisting of MnS precipitates are mainly utilized. In accordance with the process disclosed in this application, a silicon steel slab is held at a temperature of from 950° C. to 1200° C. for a period of from 30 to 200 seconds during hot-rolling so as to precipitate MnS in the form of fine, uniformly dispersed particles at a high distribution density, thereby enhancing the magnetic properties of the final product. However, in this type of grain-oriented electromagnetic steel sheet or strip wherein the dispersion phases consist of MnS precipitates when final cold-rolling is carried out at a high cold-rolling reduction ratio of from 50% to 80% so as to further improve the watt loss of the product by reducing the macro-grain size of the final product while maintaining the magnetic flux density of the grain-oriented electromagnetic steel sheet, secondary recrystallization becomes unstable, particularly at a high cold-rolling reduction ratio exceeding 60%, with the result that the magnetic properties of the resultant product are deteriorated.

A primary object of the present invention is to eliminate the above-mentioned disadvantages and to improve the magnetic properties, particularly the watt loss, of a grain-oriented electromagnetic steel sheet or strip while attaining a stable watt loss characteristic over the full length of the coiled product thereof.

Another object of the present invention is to provide a grain-oriented electromagnetic steel strip which has uniform magnetic properties due to the fine dispersion of precipitates.

In accordance with the objects of the present invention, there is provided a process for producing a grain-oriented electromagnetic steel sheet or strip, characterized in that the silicon steel material contains from 0.02% to 0.2% of copper; the exit temperature of the finishing-hot-rolling step is controlled in such a manner that the temperature of the top portion of the hot-rolled steel strip is in the range of from 900° C. to 1050° C. and the temperature of the middle and bottom portions thereof is in the range of from 950° C. to 1150° C.; and final cold-rolling of the hot-rolled steel strip is carried out at a reduction ratio of from 50% to 80%.

A grain-oriented electromagnetic steel strip according to the present invention is characterized in that:

it has a thickness of from 0.15 to 0.30 mm and contains from 2.0% to 4.0% of silicon, from 0.030% to 0.090% of manganese, and from 0.02% to 0.2% of copper; it exhibits a watt loss $W_{17/50}$ of not more than approximately 1.19 watts/kg and a magnetic flux density $B_{10}$ of not less than approximately 1.86 tesla over the full length of the coiled strip; and it is produced by a process comprising a hot-rolling step, in which the exit temperature of the finishing-hot-rolling step is controlled in such a manner that the temperature of the top portion of the hot-rolled steel strip is in the range of from 900° C. to 1050° C. and the temperature of the middle and bottom portions thereof is in the range of from 950° C. to 1150° C., and a double-stage cold-rolling step, final cold-rolling of the hot-rolled steel strip being carried out at a reduction ratio of from 50% to 80%.

In order to improve the watt loss of a grain-oriented electromagnetic steel sheet or strip, it is necessary to enhance the magnetic flux density thereof and to reduce the macro-grain diameter of the final product while maintaining the enhanced magnetic flux density. In order to accomplish this, the final cold-rolling step must be carried out at a high cold-rolling reduction ratio of from 50% to 80%. However, in the case of a silicon steel material wherein the dispersion phases consist of MnS precipitates alone, a final cold-rolling reduction ratio of 60% or more may cause secondary recrystallization to be unstable during final annealing. The present inventors considered that this disadvantage is due to the fact that the dispersion phases consisting of MnS precipitates are weak. Therefore, the present inventors made various studies in an attempt to remove the above-mentioned disadvantage and discovered that when a silicon steel material containing a predetermined amount of copper is used, secondary recrystallization can be stabilized even at a high final cold-rolling reduction ratio of from 50% to 80%, more preferably from 60% to 80%. On the basis of this discovery, the present inventors produced a grain-oriented electromagnetic steel sheet or strip according to the hot-rolling conditions described in the above-mentioned Japanese Laid-open patent application No. 48-69720 (1973), and the resultant steel strip exhibited substantially improved magnetic properties. However, there was a disadvantage in the grain-oriented electromagnetic steel sheet or strip produced according to the above-mentioned hot-rolling conditions in regard to the uniformity of the magnetic properties along the full length of the resultant coil. That is, the middle and bottom portions of the hot-rolled coil in the longitudinal direction exhibited a larger macro-grain size than did the top portion. Also, in the final product, these portions exhibited a lower magnetic flux density than did the top portion. Therefore, the improvement in the magnetic properties of these portions was not significant since the magnetic properties of the coil in the longitudinal direction thereof were not uniform. To determine the reason for the magnetic properties being nonuniform, the precipitation state of the dispersion phases consisting of $Cu_2S$ precipitates in the hot-rolled strip was observed by means of an electron microscope.

According to the process of the present invention, it is not only possible to produce a conventional 11 mil (0.28–0.30 mm) thick grain-oriented electromagnetic steel sheet or strip but also possible to produce a 9 mil (0.23 mm) or 6 mil (0.15 mm) thick grain-oriented electromagnetic steel sheet or strip.

The present invention is hereinafter described with reference to the drawings.

Figure 2A:
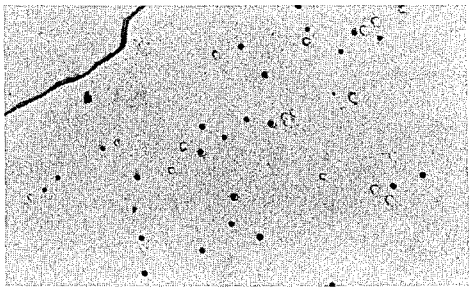
Figure 2B:
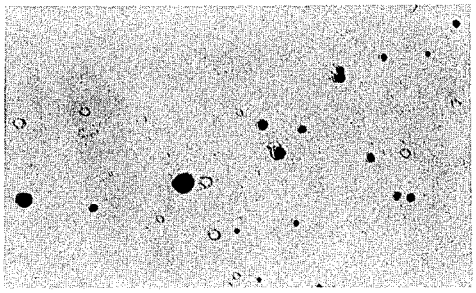
Figure 2C:
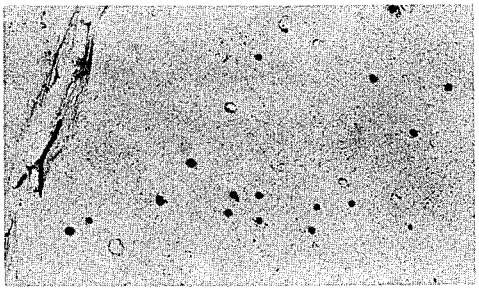
Figure 3:
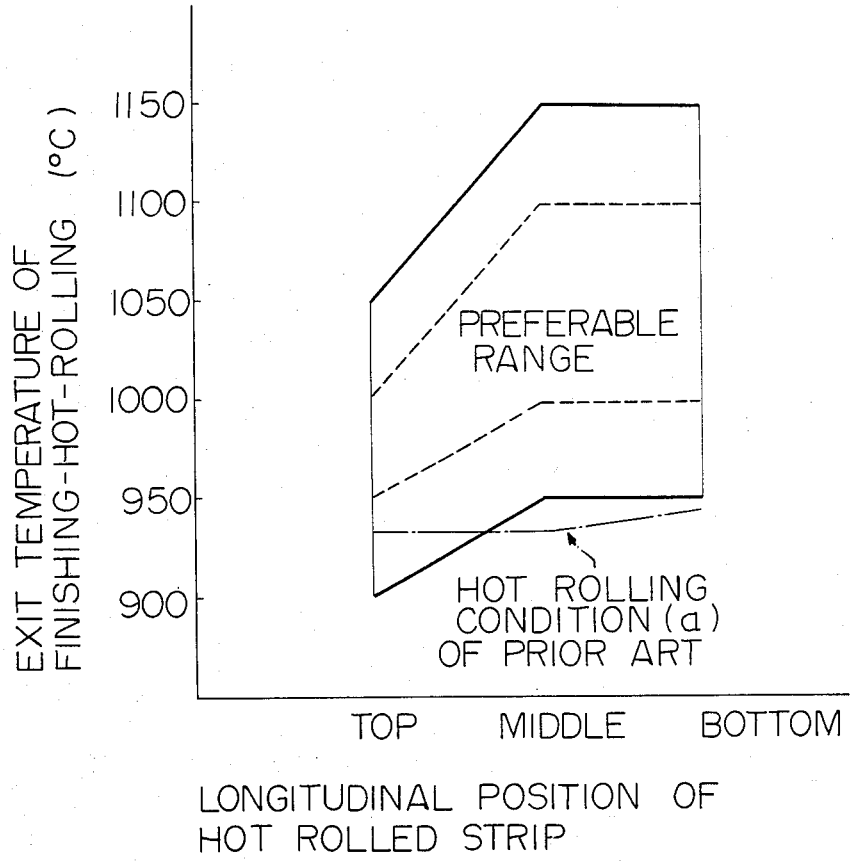

FIGS. 1A–C and 2A–C are electron microscopic photographs illustrating the precipitation state of the dispersion phases consisting of $Cu_2S$ precipitates in the top (FIGS. 1A and 2A), middle (FIGS. 1B and 2B), and bottom (FIGS. 1C and 2C) portions of the hot-rolled strips produced according to a conventional process and the process of the present invention, respectively, and FIG. 3 shows the temperature range within which the exit temperature of the finishing-hot-rolling step should be controlled according to the present invention.

As a result of observation of the precipitation state of the dispersion phase consisting of $Cu_2S$ precipitates in the hot-rolled strip, it was confirmed that there is no great difference in the total amount of sulfide precipitated in the three portions of the hot-rolled coil, but the $Cu_2S$ particles in the middle and bottom portions of the hot-rolled coil are likely to aggregate, as shown in FIGS. 1A and B.

In view of the above, the present inventors made various studies regarding control of the size of and dispersion of $Cu_2S$ particles precipitated in a silicon steel strip and succeeded in stably producing at a high yield an electromagnetic steel sheet or strip having a high magnetic flux density by adopting characteristic hot-rolling conditions wherein the exit temperature of the finishing-hot-rolling step is controlled in such a manner that the temperature of the top portion of the steel strip is in the range of from 900° C. to 1050° C. and the temperature of the middle and bottom portions thereof is in the range of from 950° C. to 1150° C., with the result that the size of $Cu_2S$ particles precipitated in the steel strip is uniform along the full length of the hot-rolled strip.

It is preferable to make the temperature of a silicon steel sheet bar along the full length thereof 1100° C. before carrying out finishing-hot-rolling so as to control the size of MnS particles precipitated in the steel strip, while at the same time insuring a temperature suitable for controlling the subsequent precipitation of $Cu_2S$ particles.

The electron microscopic photographs in FIGS. 2A, 2B and 2C illustrate the uniform precipitation state of the dispersion phases consisting of $Cu_2S$ precipitates in the top, middle, and bottom portions, respectively, of a steel strip produced by using the above-mentioned characteristic hot-rolling.

The limited production conditions of the present invention are described below.

Regarding the compositional ingredients of a silicon steel, when the carbon content of a silicon steel exceeds 0.085%, not only are the magnetic properties of the resultant product poor but also a long period of time is required for decarburization annealing, which is advantageous from an economical point of view. Therefore, the maximum carbon content is restricted to 0.085%.

Silicon is an effective element for decreasing the watt loss of a grain-oriented electromagnetic steel sheet or strip. When the silicon content is less than 2.0%, the watt loss-decreasing effect thereof is unsatisfactory. An excessively large silicon content may cause cracking during cold-rolling of the steel strip, thereby making cold-rolling difficult. The maximum silicon content in the silicon steel should, therefore, be 4.0%.

Manganese, sulfur, and copper are elements necessary for the precipitation of inhibitors and form dispersion phases which are important for the growth of secondary recrystallized grains. When the manganese, sulfur, or copper content is less than 0.030%, 0.010%, or 0.02%, respectively, the absolute amount of MnS and $Cu_2S$ precipitated as dispersion phases is insufficient, with the result that sufficient secondary recrystallization does not take place. With regard to manganese and sulfur, when the manganese content is more than 0.090% or the sulfur content is more than 0.060%, an adequate amount for precipitating MnS and $Cu_2S$ as the dispersion phases of the precipitates cannot be obtained in a silicon steel because manganese and sulfur are not sufficiently solid-dissolved into the steel matrix at the conventional temperature (1200° C. to 1400° C.) for heating a silicon steel slab, and, therefore, sufficient secondary recrystallization cannot be realized. Also, the maximum copper content in a silicon steel should be 0.2% because when the copper content is more than 0.2% the operating efficiency of the silicon steel is decreased in the steps of pickling, decarburizing-annealing, and the like. As a result, the manganese, sulfur, and copper content in the silicon steel should be in the range of from 0.030 to 0.090%, from 0.010 to 0.060%, and from 0.02 to 0.2%, respectively.

A melt of a silicon steel containing the above-mentioned elements within the above-mentioned ranges is subjected to conventional ingot making or continuous casting to produce an ingot or slab. Then the ingot or slab is heated to a temperature of from 1200° C. to 1400° C.

The characteristic hot-rolling of the present invention is described below.

With regard to the exit temperature of the finishing-hot-rolling step, when the temperature of the top portion of the steel strip exceeds 1050° C., the precipitation degree of the sulfides tends to be unsatisfactory so that secondary recrystallization is unstable. When the temperature of the top portion is less than 900° C., the aggregation of $Cu_2S$ particles occurs, thereby creating a disadvantage. If the temperature of the middle and bottom portions of the steel strip is less than 950° C., the $Cu_2S$ particles precipitated aggregate to such a degree that the inhibition effect thereof is drastically reduced and macrograin coarsening of the product and the generation of streaks occur. If the temperature of the middle and bottom portions exceeds 1150° C., the precipitation of $Cu_2S$ is so insufficient that the final product exhibits deteriorated magnetic properties and a magnetic abnormality. Therefore, in accordance with the present invention, the entrance temperature of the finishing-hot-rolling step should be in the range of from 1100° C. to 1250° C. and the exit temperature of the finishing-hot-rolling step should be in the range of from 900° C. to 1050° C., preferably from 950° C. to 1000° C., in the case of the top portion of the steel strip and from 950° C. to 1150° C., preferably from 1000° C. to 1100° C., in the case of the middle and bottom portions.

FIG. 3 shows the temperature range within which the exit temperature is controlled. An exit temperature of the finishing-hot-rolling step within the range shown in FIG. 3 can be obtained by controlling descaling or by controlling the number of revolutions of the rolls during rough-rolling and finishing-rolling.

When the entrance temperature of the finishing-hot-rolling step is more than 1250° C., the precipitation degree of the sulfides tends to be unsatisfactory so that secondary recrystallization is unstable and the final product contains abnormally coarse grains generated during the slab-heating step. Also, when the entrance temperature of the finishing-hot-rolling step is less than 1100° C., the precipitated sulfide particles aggregate to such a degree that the inhibition effect thereof is drastically reduced, with the result that secondary recrystallization is unstable.

The cold-rolling step is now described. The cold-rolling step is carried out by a conventional double cold-rolling method including first cold-rolling, intermediate annealing, the second cold-rolling, after which decarburization annealing and final finishing annealing are carried out.

It is necessary that the silicon steel of the present invention basically contain manganese, sulfur, and copper in the above-specified ranges. The silicon steel of the present invention may further contain a trace amount of tin for the purpose of reducing the size of the crystal grains, thereby attaining a further decreased watt loss in the final product. It is preferable that the tin content be 0.10% or less.

Also, when the phosphorus content in the silicon steel is reduced to a remarkably low level, the amount of phosphorus-type inclusions can be reduced so as to obtain an optimal precipitation state of the dispersion phases which is effective for enhancing the magnetic flux density and for reducing the watt loss of the final product. In order to reduce the amount of phosphorus-type inclusions and thereby obtain the above-mentioned results, it is necessary that the phosphorus content be 0.01% or less. If the phosphorus content exceeds 0.01%, it will be difficult to attain the above-mentioned results.

EXAMPLE 1

Three types of molten silicon steels each having the composition indicated in Table 1 were prepared. Each molten silicon steel was subjected to continuous casting to produce slabs having a thickness of 250 mm. The slabs were heated to a temperature of from 1200° C. to 1400° C. and were hot-rolled under the conditions indicated in Table 1 to obtain a hot-rolled coil having a thickness of 2.5 mm. The hot-rolled coil was subjected to double-stage cold-rolling, including intermediate annealing, carried out at a temperature of 850° C. for 3 minutes. In double-stage cold-rolling, second cold-rolling was carried out at a cold-rolling reduction ratio of 65% to obtain steel strips having a final thickness of 0.30 mm. The steel strips were decarburized in a wet hydrogen atmosphere at a temperature of 840° C. for 3 minutes. Then the decarburized steel strips were final-annealed in a hydrogen atmosphere at a temperature of 1170° C. for 20 hours. The resultant final products exhibited the properties indicated in Table 2.

TABLE 1

| | | Conventional Material | Material of Present Invention A | | Material of Present Invention B | |
|---|---|---|---|---|---|---|
| Composition (%) | C | 0.043 | 0.043 | | 0.043 | |
| | Si | 3.15 | 3.15 | | 3.14 | |
| | Mn | 0.060 | 0.060 | | 0.060 | |
| | S | 0.017 | 0.026 | | 0.026 | |
| | sol. Al | 0.002 | 0.002 | | 0.002 | |
| | Total N | 0.0025 | 0.0025 | | 0.0025 | |
| | Cu | 0.01 | 0.03 | | 0.18 | |
| Temperature Before Finishing (°C.) | Top | 1170 | 1200 | 1170 | 1200 | |
| | Middle | 1110 | 1150 | 1110 | 1150 | |
| | Bottom | 1070 | 1100 | 1070 | 1100 | |
| Exit Temperature Finishing-Hot-Rolling (°C.) | Top | 930 | 980 | 930 | 980 | |
| | Middle | 930 | 1000 | 940 | 1000 | |
| | Bottom | 940 | 1020 | 940 | 1020 | |
| Hot-Rolling Condition | | a* | b** | a* | b** | |

*USP No. 3,872,704
**Hot-rolling condition of the present invention.

TABLE 2

| Condition | Macro-Grain of Product | Grain Size of Product (ASTM No.) Average of Top, Middle, and Bottom | Magnetic Properties Top $W_{17/50}$ | Top $B_{10}$ | Middle $W_{17/50}$ | Middle $B_{10}$ | Bottom $W_{17/50}$ | Bottom $B_{10}$ |
|---|---|---|---|---|---|---|---|---|
| Conventional Material + a* | Good | 6.0 | 1.24 watts/kg | 1.85 tesla | 1.28 watts/kg | 1.84 tesla | 1.30 watts/kg | 1.84 tesla |
| Material A + b** | Good | 8 | 1.18 | 1.87 | 1.19 | 1.86 | 1.18 | 1.87 |
| Material B + a* | Good | 7.0 | 1.20 | 1.86 | 1.26 | 1.85 | 1.24 | 1.86 |
| Material B + b** | Good | 7.6 | 1.17 | 1.87 | 1.18 | 1.86 | 1.18 | 1.86 |

*Hot-rolling condition of USP No. 3,872,704
**Hot-rolling condition of the present invention.

EXAMPLE 2

A total of 0.08% Sn was added to a molten silicon steel containing 0.043% C, 3.14% Si, 0.060% Mn, 0.026% S, 0.002% sol. Al, 0.0025% total N, and 0.18% Cu. The resultant steel and the conventional steel having the composition given in Table 1 were subjected to continuous casting so as to produce slabs having a thickness of 250 mm. The slabs were heated to a temperature of from 1200° C. to 1400° C. and were hot-rolled under hot-rolling condition b of Table 1 to obtain hot-rolled coils having a thickness of 2.5 mm. The hot-rolled coils were then subjected to double cold-rolling, including intermediate annealing, carried out at a temperature of 850° C. for 3 minutes. In the double cold-rolling, secondary cold-rolling was carried out at a reduction ratio of 65% so as to obtain steel strips having a final thickness of 0.3 mm. The steel strips were decarburized in a wet hydrogen atmosphere at a temperature of 840° C. for 3 minutes. Then the decarburized steel strips were final-annealed in a hydrogen atmosphere at a temperature of 1170° C. for 20 hours. The resultant final products exhibited the properties indicated in Table 3.

TABLE 3

| | Grain Size of Product (ASTM No.) Average of Top, Middle, and Bottom | Magnetic Properties | | | | | |
|---|---|---|---|---|---|---|---|
| | | Top | | Middle | | Bottom | |
| | | $W_{17/50}$ | $B_{10}$ | $W_{17/50}$ | $B_{10}$ | $W_{17/50}$ | $B_{10}$ |
| Conventional Material + a* | 6.0 | 1.24 watts/kg | 1.85 tesla | 1.28 watts/kg | 1.84 tesla | 1.30 watts | 1.84 tesla |
| Material of Present Invention | 8.0 | 1.16 | 1.87 | 1.16 | 1.86 | 1.16 | 1.86 |

*Hot-rolling condition of USP No. 3,872,704

EXAMPLE 3

A molten silicon steel was treated so that it contained 0.043% C, 3.14% Si, 0.060% Mn, 0.026% S, 0.002% sol. Al, 0.0025% total N, and 0.18% Cu and so that the phosphorus content was reduced to a low level of 0.006%. The resultant silicon steel was subjected to continuous casting so as to produce a slab having a thickness of 250 mm. The slab was heated to a temperature of from 1200° C. to 1400° C. and was hot-rolled under condition b of Table 1 so as to obtain a hot-rolled coil having a thickness of 2.5 mm. The hot-rolled coil was subjected to double-stage cold-rolling, including intermediate annealing, carried out at a temperature of 850° C. for 3 minutes. In double-stage cold-rolling, second cold-rolling was carried out at a reduction ratio of 65% so as to obtain a steel strip having a final thickness of 0.3 mm. The steel strip was decarburized in a wet hydrogen atmosphere at a temperature of 840° C. for 3 minutes. Then the decarburized steel strip was finish-annealed in a hydrogen atmosphere at a temperature of 1170° C. for 20 hours. The resultant final products exhibited the properties indicated in Table 4.

TABLE 4

| | Grain Size of Product (ASTM No.) Average of Top, Middle, and Bottom | Magnetic Properties | | | | | |
|---|---|---|---|---|---|---|---|
| | | Top | | Middle | | Bottom | |
| | | $W_{17/50}$ | $B_{10}$ | $W_{17/50}$ | $B_{10}$ | $W_{17/50}$ | $B_{10}$ |
| Material of Present Invention | 8.0 | 1.16 watts/kg | 1.87 tesla | 1.16 watts/kg | 1.87 tesla | 1.17 watts/kg | 1.87 tesla |

We claim:

1. A process for producing a grain-oriented electromagnetic steel sheet or strip having a low watt loss, wherein:

a silicon steel slab containing not more than 0.085% by weight of carbon, from 2.0% to 4.0% by weight of silicon, from 0.030% to 0.090% by weight of manganese, and from 0.010% to 0.060% by weight of sulfur, the balance being essentially iron and unavoidable impurities, is hot-rolled, cold-rolled and final-annealed, wherein final cold-rolling is carried out at a reduction ratio of from 50% to 80%;

said silicon steel slab additionally contains from 0.02% to 0.2% by weight of copper;

the exit temperature of the finishing-hot-rolling step is controlled so that the size of $Cu_2S$ particles formed by said copper and said sulfur is uniform along the full length of a hot-rolled strip; and temperature of the top portion of the hot-rolled strip is in the range of from 900° C. to 1050° C., and temperature of the middle and bottom portions thereof is in the range of from 950° C. to 1150° C.

2. A process according to claim 1, characterized in that the entrance temperature of said finishing-hot-rolling step is from 1100° C. to 1250° C.

3. A process according to claim 2, characterized in that said temperature of said top portion is from 950° C. to 1000° C.

4. A process according to claim 2, characterized in that said temperature of said middle and bottom portions is from 1000° C. to 1100° C.

5. A process according to claim 1, characterized in that the phosphorus content in said silicon steel slab is 0.010% by weight or less.

6. A process according to claim 1 or 5, characterized in that said silicon steel slab contains not more than 0.1% by weight of tin.

* * * * *